US007040546B2

(12) United States Patent
Horan et al.

(10) Patent No.: US 7,040,546 B2
(45) Date of Patent: May 9, 2006

(54) SINGLE BEAM SPRAY GUN POSITIONING SYSTEM

(75) Inventors: Nicholas R. Horan, Cedar Falls, IA (US); Christopher M. Horan, Waterloo, IA (US); Scott J. Horan, Waterloo, IA (US)

(73) Assignee: Laser Touch and Technologies, LLC, Cedar Falls, IA (US)

( * ) Notice: Subject to any disclaimer, the term of this patent is extended or adjusted under 35 U.S.C. 154(b) by 0 days.

(21) Appl. No.: 10/103,498

(22) Filed: Mar. 20, 2002

(65) Prior Publication Data

US 2003/0178503 A1 Sep. 25, 2003

(51) Int. Cl.

| | |
|---|---|
| ***B05D 17/00*** | (2006.01) |
| ***B05D 15/00*** | (2006.01) |
| ***B05D 7/02*** | (2006.01) |
| ***B05D 9/01*** | (2006.01) |
| ***B67D 5/08*** | (2006.01) |

(52) U.S. Cl. ..... 239/1; 239/71; 239/73; 239/289; 239/526; 239/DIG. 14

(58) Field of Classification Search ..... 239/1, 239/71, 73, 289, DIG. 14, 526; 118/713
See application file for complete search history.

(56) References Cited

U.S. PATENT DOCUMENTS

| | | | | |
|---|---|---|---|---|
| 3,784,804 | A * | 1/1974 | Sabetelli et al. | 239/289 |
| 3,812,340 | A * | 5/1974 | Brandt | 362/96 |
| 4,291,839 | A * | 9/1981 | Brett | 239/289 |
| 5,358,568 | A * | 10/1994 | Okano et al. | 239/73 |
| 5,517,768 | A | 5/1996 | Aviv | |
| 5,598,972 | A | 2/1997 | Klein, II et al. | |
| 5,757,498 | A | 5/1998 | Klein, II et al. | |
| 5,797,670 | A * | 8/1998 | Snoke et al. | 362/119 |
| 5,857,625 | A | 1/1999 | Klein et al. | |
| 5,868,840 | A | 2/1999 | Klein, II et al. | |
| 5,951,296 | A | 9/1999 | Klein | |
| 6,557,815 | B1 * | 5/2003 | Klein, II | 248/635 |

FOREIGN PATENT DOCUMENTS

| | | |
|---|---|---|
| DE | 19832206 | 10/1999 |
| JP | 09136151 | 5/1997 |

* cited by examiner

*Primary Examiner*—David A. Scherbel
*Assistant Examiner*—Darren Gorman
(74) *Attorney, Agent, or Firm*—Boyle, Fredrickson, Newholm, Stein & Gratz, S.C.

(57) ABSTRACT

A system for positioning a spray apparatus relative to a surface, in which the spray apparatus directs a liquid coating such as paint toward the surface for applying the liquid to the surface in a spray pattern. A light beam emitter is interconnected with the spray apparatus, and emits a light beam in a predetermined orientation relative to the spray pattern such that the light beam strikes the surface in a center defined by the spray pattern when the spray apparatus is positioned a predetermined distance from the surface. The light beam is oriented such that the distance of the spray apparatus corresponds to a distance providing optimal application of the coating to the surface, to minimize waste and overspray. The light beam emitter may be engaged with the spray apparatus by a releasable mounting arrangement, such that the light beam emitter can be selectively mounted to the spray apparatus. The light beam is emitted from a light beam emitter housing, such as a laser generator. The angle of the light beam relative to the spray pattern can be adjusted so as to vary the distance from the surface at which the light beam coincides with the center of the spray pattern, to provide a gauge for optimal spray application for varying spray parameters.

14 Claims, 8 Drawing Sheets

FIG. 3
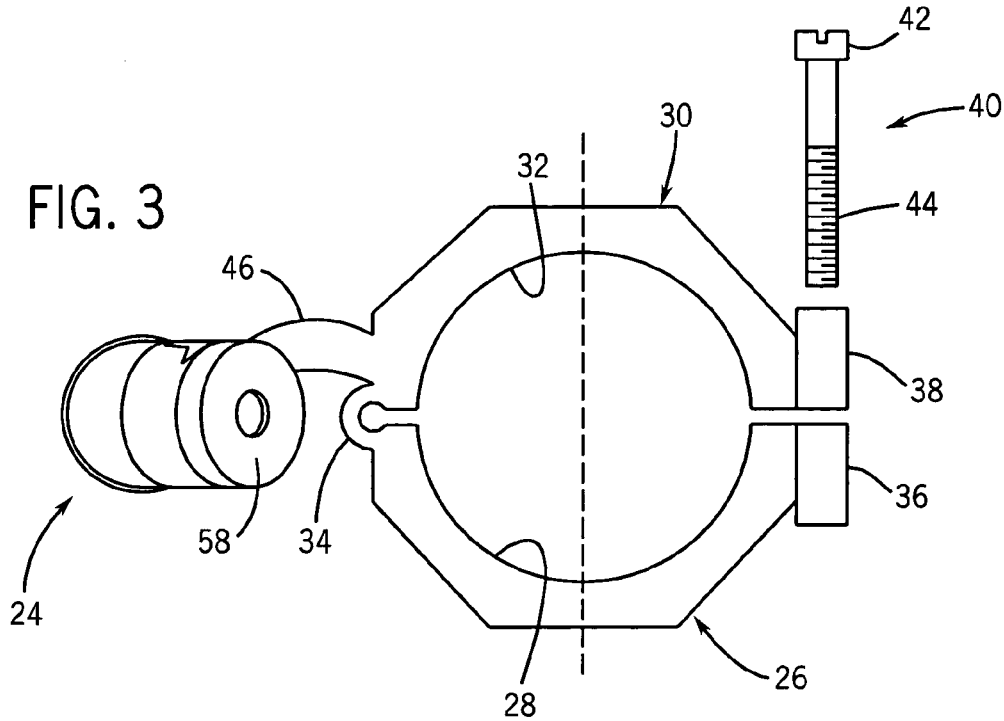
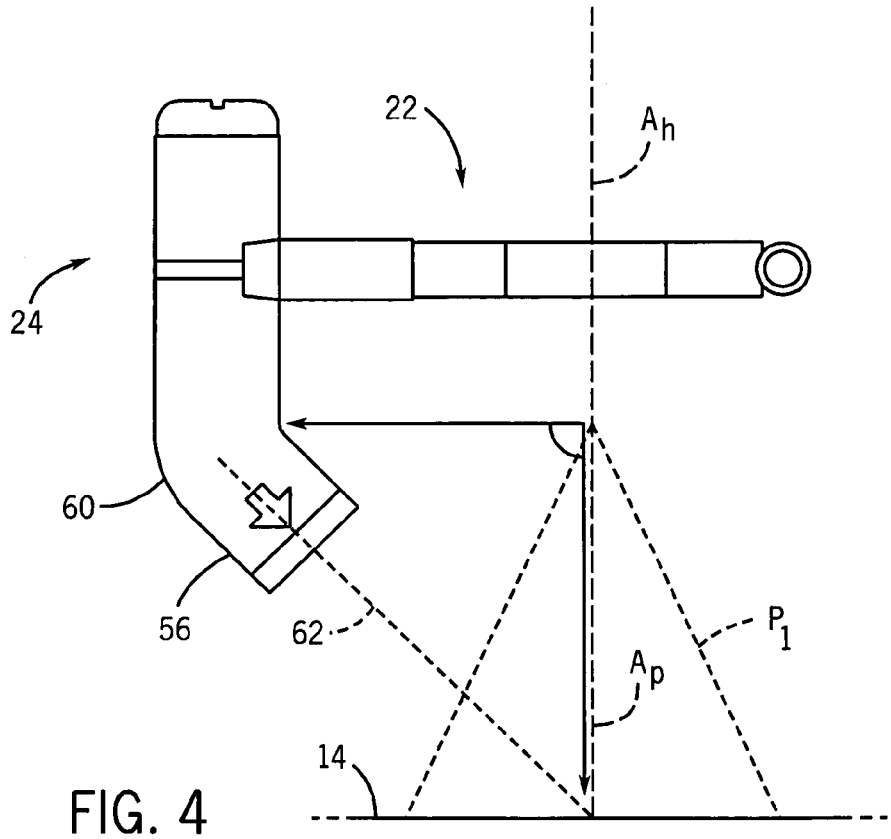
FIG. 4

SINGLE BEAM SPRAY GUN POSITIONING SYSTEM

BACKGROUND AND SUMMARY OF THE INVENTION

This invention relates to spray application of a liquid, such as a paint or other coating, to a surface, and more particularly to a system for targeting and positioning a spray applicator relative to the surface.

In applying a liquid to a surface using a spray gun or other spray applicator, it is advantageous to position the spray applicator in a manner which reduces overspray and minimizes waste spray, so as to provide optimal application of the liquid to the surface. In a spray paint or coating application, this reduces the amount of volatile organic compounds (VOCs) discharged into the air, which is advantageous from an environmental and regulatory compliance standpoint.

Systems have been developed for positioning a spray apparatus relative to a surface or substrate to which the spray liquid is to be applied. Representative systems are shown in Klein, II et al. U.S. Pat. No. 5,598,972 issued Feb. 4, 1997; Klein, II et al. U.S. Pat. No. 5,757,498 issued May 26, 1998; Klein et al. U.S. Pat. No. 5,857,625 issued Jan. 12, 1999; and Klein, U.S. Pat. No. 5,951,296 issued Sep. 14, 1999; the disclosures of which are hereby incorporated by reference. Generally, these patents illustrate the concept of mounting a light beam emission arrangement in a spray apparatus such as a spray paint gun. The light beam emission apparatus directs a pair of light beams in a direction from the gun toward the surface to be sprayed. The light beams are oriented so as to converge toward each other in a direction from the gun toward the surface. The light beams merge together into a single point of light at a predetermined distance from the spray head of the spray gun, which corresponds to the distance of the spray head from the surface that provides optimal application of the spray coating to the surface and minimizes overspray and waste. The angle of the light beams can be adjusted to vary the convergent distance according to different operating parameters or characteristics, such as air pressure, coating type and the like. While this type of targeting and positioning system is effective to optimize application of the spray coating, the light beam generator involves a certain amount of complexity and expense in manufacture and in mounting to the spray apparatus. Certain embodiments involve modifications to the housing or other components of the spray apparatus in order to mount the light beam generator. Further, the use of dual light beams involves generating a light beam and splitting the single beam into two light beams, and subsequently directing the split beams toward the surface at an angle relative to each other. Although this provides a highly accurate and advantageous targeting and positioning system, it also requires precision in manufacturing and positioning of the components.

It is an object of the present invention to provide a simplified targeting and positioning system for a spray apparatus, for use in applying a spray liquid such as a paint or other coating to a surface. It is a further object of the invention to provide such a system which can be quickly and easily mounted to or incorporated in conventional spray-type equipment and which provides a light beam system for positioning the spray apparatus relative to the surface so as to optimize application of the liquid to the surface. It is a further object of the invention to provide such a system which can be quickly and easily engaged with or disengaged from the spray equipment. Yet another object of the invention is to provide such a system which takes advantage of advances in light beam emission technology for providing a low cost, easily adaptable system for positioning a spray apparatus relative to a surface. Yet another object of the invention is to provide such a system which is simple in its components and construction, yet which provides the ability to position the spray pattern on the surface with a relatively high degree of accuracy.

In accordance with one embodiment of the invention, a spray applicator positioning and targeting system includes a mounting arrangement releasably engageable with a spray apparatus, such as the spray head of a spray gun. A light beam generator and emitter is interconnected with the mounting arrangement, and is secured in a predetermined orientation relative to the mounting arrangement. When the mounting arrangement is engaged with a spray apparatus, such as the spray head of a spray gun, the light beam generator and emitter functions to emit a light beam in a direction away from the spray head, in a predetermined orientation relative to the spray head which corresponds to the orientation of the light beam generator and emitter relative to the mounting arrangement.

The orientation of the light beam generator and emitter, when mounted to the spray apparatus, is such that the light beam coincides with the center of the spray pattern of the liquid sprayed by the spray apparatus at a predetermined distance from the discharge point of the coating from the spray apparatus. The predetermined distance corresponds to the distance providing optimal application of the spray coating to the surface. In this manner, the user manipulates and positions the spray apparatus so as to maintain the light beam in the center of the spray pattern as the spray apparatus is moved, thus applying the spray coating to the surface in a manner which optimizes application of the coating to the surface.

The mounting arrangement may be in the form of a split ring-type member or collar adapted for mounting to the spray head of the spray apparatus. The light beam generator and emitter may be in the form of a laser beam emitter having a laser beam generator and a power supply housing secured to the mounting arrangement. In a fixed position embodiment, the laser beam generator is secured to the mounting arrangement in a predetermined orientation. Separate mounting assembly and light beam generator systems can be provided, with each laser beam generator being oriented so as to emit a laser beam at a different angle relative to the mounting arrangement. A user selects a desired one of the mounting arrangement/laser beam generator systems for securement to the spray apparatus, with the selected system emitting a laser beam so as to coincide with the center of the spray pattern at a predetermined distance from the surface. In a variable position embodiment, a single light beam generator is secured to the mounting arrangement, and the orientation of the light beam relative to the spray apparatus can be adjusted. In one version, an emitter head is engaged with the light beam generator in varying orientations so as to vary the angle of the light beam and thereby the distance from the surface at which the light beam corresponds with the center of the spray pattern. In another version, the light beam generator and emitter head can be moved to various angular positions relative to the mounting arrangement, to vary the angle of the light beam relative to the spray apparatus.

In accordance with another embodiment of the invention, the light beam generator and emitter is associated with or incorporated into the body of the spray apparatus. The light beam generator and emitter is positioned so as to emit the light beam forwardly in the direction of the spray pattern. The light beam generator and emitter is oriented so as to emit the light beam at an angle relative to the centerline of the spray pattern, such that the light beam converges with the center of the spray pattern at a predetermined distance from the spray head, according to the optimal application distance for the coating. The light beam generator and emitter may be in a fixed position relative to the nozzle, or may be adjustable so as to vary the angle of convergence according to the parameters of the spray coating or spray apparatus.

The invention also contemplates a method of positioning a spray apparatus and applying a spray coating to a surface, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 3 is a front elevation view of the targeting and positioning system of FIGS. 1 and 2;

FIG. 4 is a view similar to FIG. 2, showing emission of a light beam at a first angle so as to coincide with the center of the spray pattern at a first distance;

DETAILED DESCRIPTION OF THE INVENTION

Figure 1:
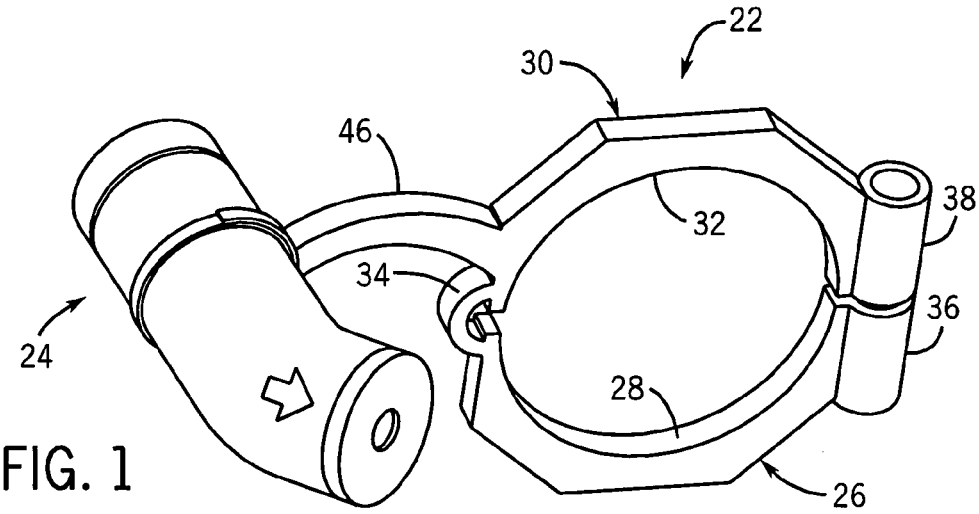
FIG. 1 is an isometric view of a first embodiment of a spray apparatus targeting and positioning system constructed according to the invention.
Figure 2:
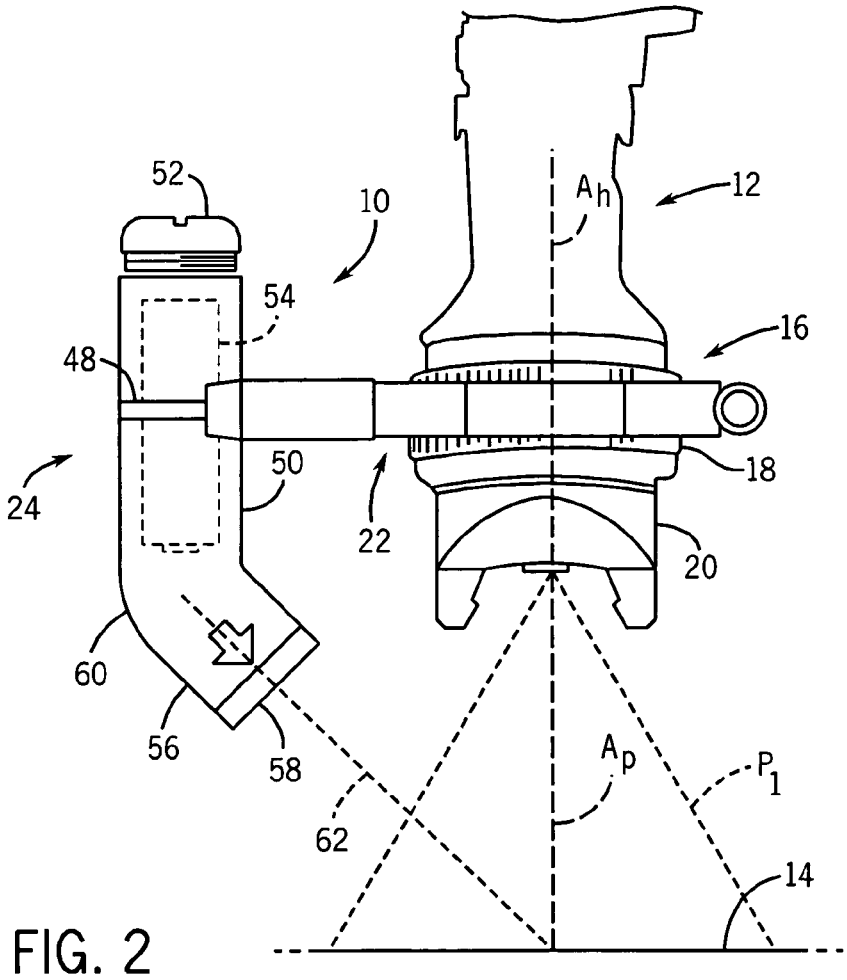
FIG. 2 is a top plan view showing the targeting and positioning system of FIG. 1 as mounted to the head of a spray apparatus, such as a spray gun.

Referring to FIGS. 1–3, in a first embodiment of the invention, a targeting and positioning system 10 is adapted for use in combination with a spray system. In the illustrated embodiment, targeting and positioning system 10 is shown as being employed in connection with a spray gun 12 forming a part of a spray paint or coating apparatus for applying a spray coating to a surface 14. Spray gun 12 includes a spray head 16 having a ring or collar 18 adapted to secure a spray nozzle 20 to the spray head 16, in a manner as is known.

Generally, targeting and positioning system 10 includes a mounting arrangement 22 and a light beam generator and emitter 24 secured to mounting arrangement 22.

Mounting arrangement 22 is in the form of a split ring device adapted for releasable mounting to collar 18 of spray gun 12. Mounting arrangement 22 includes a lower U-shaped section 26 defining an arcuate inner edge 28, and an inverted U-shaped upper section 30 defining an arcuate inner edge 32. Lower inner edge 28 and upper inner edge 32 have matching radii, and define a generally circular opening when lower section 26 and upper section 30 are fitted together.

A flexible connector section 34 interconnects lower section 26 with upper section 30. Connector section 34 is preferably integrally formed with the material of lower section 26 and upper section 30, and is flexible so as to allow lower and upper sections 26, 30, respectively, to be moved apart and together. Opposite connector section 34, lower section 26 includes a tubular internally threaded lower boss 36, and upper section 30 includes a tubular upper boss 38. Lower and upper bosses 36, 38 define axially extending internal passages which are adapted to be placed into alignment with each other. A threaded connector 40, which includes a head 42 and a threaded shank 44, is adapted to extend through upper boss 38 such that the threads of shank 44 are engageable with the internal threads in lower boss 36. Head 42 is sized so as to have a transverse dimension greater than that of the passage in upper boss 38.

A support arm 46 extends outwardly from upper section 30 adjacent connector section 34. Light beam generator and emitter 24 is secured to the outer end of support arm 46 via a mounting ring 48.

Light beam generator and emitter 24 includes a cylindrical body section 50 having a screw threaded cap 52 adapted to selectively enclose an internal cavity defined by body 50, within which a battery 54 is received for powering light beam generator and emitter 24. Ring 48 encircles body 50, for securing light beam generator and emitter 24 to the outer end of support arm 46.

Light beam generator and emitter 24 further includes an emitter head 56 having a translucent emitter aperture 58, in combination with a wedge-shaped spacer 60 located between emitter head 56 and the end of body section 50. Power from battery 54 is supplied to a laser beam generator contained within the interior of emitter head 56, which representatively may be a laser beam generator such as is available from World Star Tech of Toronto, Canada under its Model No. LQB-650, although it is understood that any other satisfactory type of laser beam generator may be employed. Emitter head 56 may be secured to spacer 60 in any satisfactory manner, such as via a threaded screw-type engagement or a snap-fit arrangement. Spacer 60 is also engaged with the end of body section 50 in any satisfactory manner, such as via a snap-fit or interference fit arrangement.

Lower section 26 and upper section 30 of mounting arrangement 22 lie in a common plane, and emitter head 56 of light beam generator and emitter 24 is oriented so as to emit a light beam, shown at 62, at a predetermined angle relative to the plane of lower and upper sections 26, 30, respectively.

Targeting and positioning system 10 is secured to spray gun 12 by engaging lower and upper sections 26, 30, respectively, with a component of spray gun 12, such as nozzle collar 18. To accomplish this, lower section 26 and upper section 30 are spread apart from each other such that collar 18 is received within the space between lower section 26 and upper section 30, as defined by inner edges 28, 32, respectively. Connector section 34 is flexible so as to accommodate such spreading apart of lower section 26 and upper section 30. Lower section 26 and upper section 30 are then moved together to engage inner edges 28, 32 with collar 18, and connector 40 is inserted through the passage of upper boss 38 such that threaded shank 44 engages the internal threads of lower boss 36. Connector 40 is turned so as to bring head 42 into engagement with the upper end of upper boss 38, to securely clamp lower section 26 and upper section 30 onto collar 18. The plane of lower section 26 and upper section 30 is preferably oriented so as to be perpendicular to the longitudinal axis of spray head 16, such that the longitudinal axis of body section 50 of light beam generator and emitter 24 is substantially parallel to the longitudinal axis of spray head 16.

Emitter head 56 is positioned at an angle relative to body section 50 by means of the wedge-shaped construction of spacer 60, such that light beam 62 extends at an angle relative to the longitudinal axis of spray head 16. Light beam 62 converges toward the longitudinal axis of spray head 16 in a direction outwardly of nozzle 20.

Referring to FIG. 4, operation of spray gun 12 functions to discharge a liquid coating such as paint or the like, onto surface 14 in a generally conical spray pattern $P_1$. The longitudinal axis of spray head 16, shown at $A_h$ is coincident with the centerline of spray pattern $P_1$, shown at $A_p$. Emitter head 56 is positioned such that light beam 62 intersects spray pattern centerline $A_p$ at a predetermined distance from the point at which spray pattern $P_1$ is generated upon discharge from nozzle 20, which corresponds to the distance at which spray pattern $P_1$ provides optimal application of the spray coating to surface 14.

In use, the operator first secures targeting and positioning system 10 to spray head 16 as described above, and then actuates light beam generator and emitter 24 prior to operation of spray gun 12 to direct light beam 62 toward surface 14. The operator then approximates the known optimal distance of nozzle 20 from surface 14, and commences operation of spray gun 12 to discharge the liquid or coating onto surface 14 in spray pattern $P_1$. During movement of spray gun 12, the operator maintains spray head 16 at the optimal distance from surface 14 by maintaining the point of light on surface 14 from light beam 62 in the center of spray pattern $P_1$. That is, light beam 62 strikes surface 14 to form a point of light thereon, and the operator visually ascertains the position of the point of light from light beam 62 relative to spray pattern $P_1$, and maintains the light beam as close as possible to the spray pattern centerline $A_p$ during movement of spray gun 12 relative to surface 14. The predetermined distance of convergence provided by the angle of light beam 62 is selected so as to correspond to the known optimal distance of nozzle 20 from surface 14 for the liquid or coating being applied to surface 14, such that maintaining the point of light from light beam 62 in the center of spray pattern $P_1$ on surface 14 results in optimal application of the liquid or coating so as to minimize overspray or waste. If the operator moves spray head 16 toward or away from surface 16 to vary from the optimal distance, the point of light from light beam 62 moves either leftwardly or rightwardly relative to the spray pattern centerline $A_p$, to provide the operator with a visual indication as to the variation from the optimal spray distance.

In addition, light beam 62 can be employed to ascertain the spray pattern overlap. For example, the operator obtains a 50% overlap by positioning the point of light from light beam 62 on the wet edge of a previous pass of spray pattern $P_1$ onto surface 14. Light beam 62 also provides accurate targeting of spray pattern $P_1$ by providing a visual indication as to the location at which spray pattern $P_1$ will be applied to surface 14 before commencing operation of spray gun 12.

With this arrangement, spray pattern $P_1$ and its associated centerline $A_p$ essentially serves as a reference, which is employed in combination with convergent light beam 62 to position spray head 16 relative to surface 14.

Figure 5:
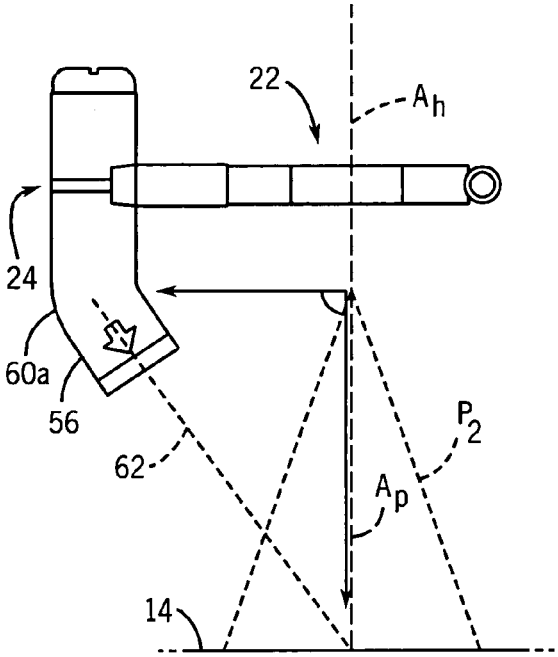
FIG. 5 is a view similar to FIG. 4, showing emission of the light beam at a second angle corresponding to a second distance.
Figure 6:
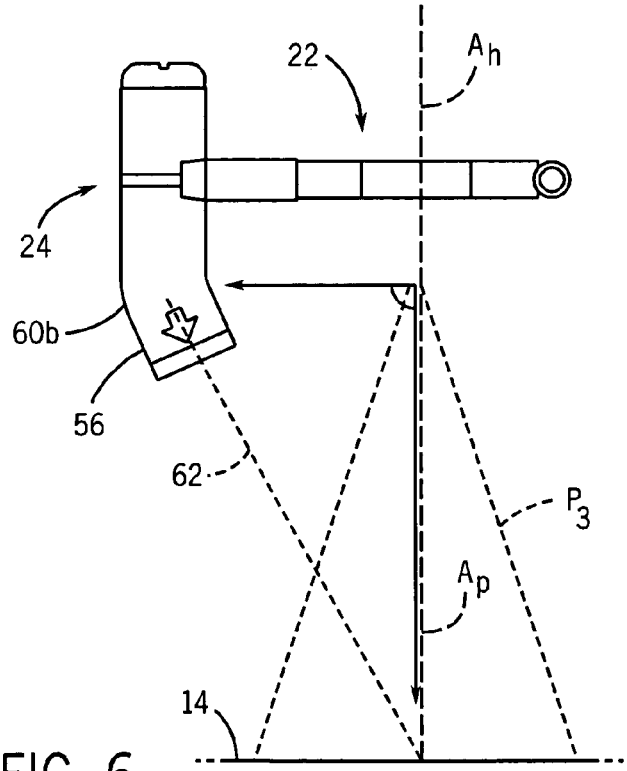
FIG. 6 is a view similar to FIGS. 4 and 5, showing emission of the light beam at a third angle corresponding to a third distance.
Figure 7:
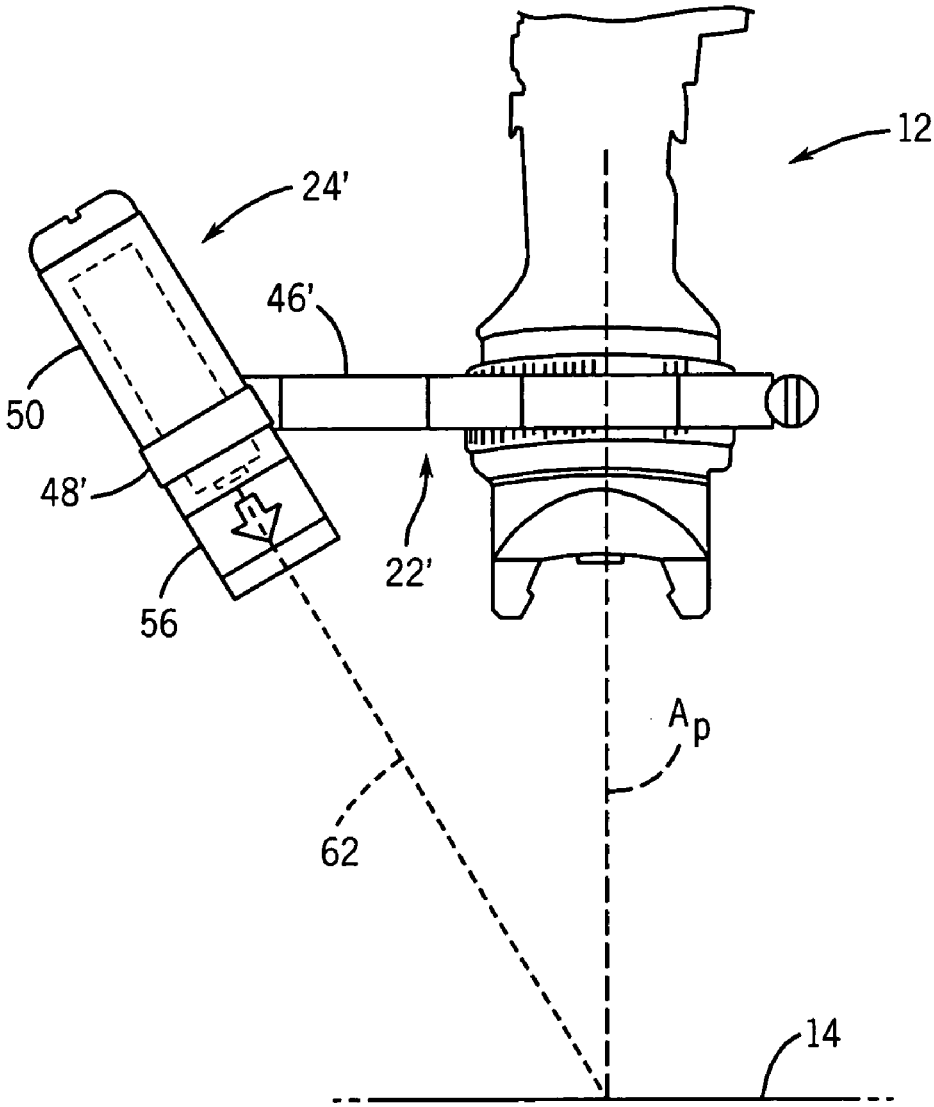
FIG. 7 is a view similar to FIG. 2, showing another embodiment of a spray apparatus targeting and positioning system for use in positioning a spray apparatus relative to a surface.

FIG. 5 illustrates targeting and positioning system 10 modified so as to lengthen the convergence distance of light beam 62. To accomplish this, spacer 60 of FIG. 4 is replaced with a different wedge-shaped spacer **60*a* between emitter head 56 and body section 50. Spacer 60*a* defines a lesser angle between its surfaces in engagement with body section 50 and emitter head 56, such that light beam 62 is directed so as to converge with the centerline of spray pattern $P_2$ at a distance greater than that provided by spacer 60, corresponding to the optimal application distance for spray pattern $P_2$. FIG. 6 illustrates yet another version utilizing a wedge-shaped spacer 60*b* for providing an increased distance of convergence, for providing optimal application of liquid in spray pattern $P_3$ to surface 14**.

With the above-described construction, the manufacturer of targeting and positioning system 10 can offer mounting arrangement 22 in combination with light beam generator and emitter body section 50 and emitter head 56, along with a series of spacers such as 60, **60*a* and 60*b*, so as to allow the operator to select an appropriate spacer for the parameters or characteristics of spray gun 12 and of the liquid or coating being applied to surface 14. Alternatively, the manufacturer can produce body section, emitter head and structure analogous to spacers 60, 60*a* and 60*b* into an integral assembly, such that a separate mounting arrangement and light beam generator and emitter is provided for mounting to spray head 16** for each different distance of convergence.

Figure 8:
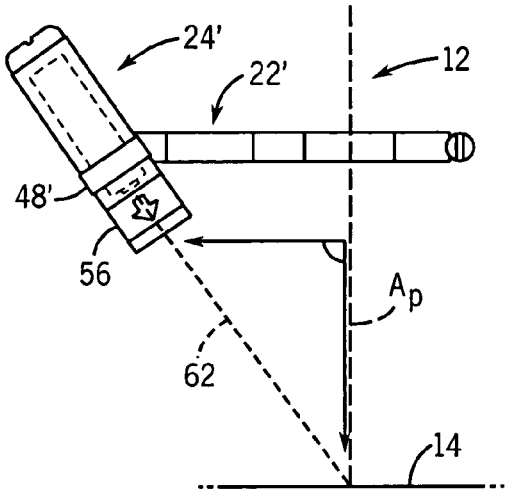
FIGS. 8–10 are views similar to FIGS. 4–6 showing varying angles of light beam emission for the targeting and positioning system of FIG. 7.
Figure 9:
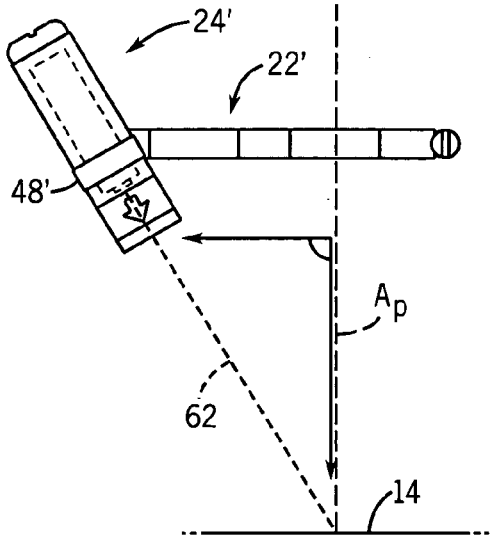
Figure 10:
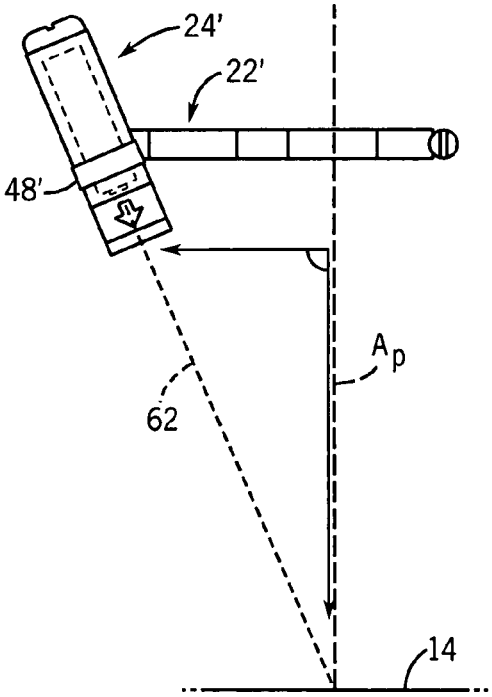

FIGS. 7–10 illustrate an alternate embodiment, and like reference characters will be used where possible to facilitate clarity. In this embodiment, light beam generator and emitter 24' is constructed so as to engage emitter head 56' directly with body section 50', so that light beam 62 is emitted in a direction coincident with the longitudinal axis of body section 60' and emitter head 56', which is oriented at an angle to the plane occupied by the components of mounting arrangement 22'. In this version, ring 48 encircles body section 50' and is oriented at an angle relative to support arm 46', to support light beam generator and emitter 24'. The angle of light beam generator and emitter 24' relative to mounting arrangement 22' can be varied as shown in FIGS. 8–10, for varying the distance at which light beam 62 converges with the spray pattern centerline $A_p$. Again, a separate mounting arrangement 22' and light beam generator and emitter' may be provided in which light beam generator and emitter 24' is secured at a different angle relative to mounting arrangement 22' for each predetermined distance. Alternatively, a pivotable mounting arrangement 22' may be interposed between light beam generator and emitter 24' and mounting arrangement 22', to enable light beam generator and emitter 24' to be positioned in various angles relative to mounting arrangement 22'. The pivotable mounting arrangement may provide infinite angular adjustment of light beam generator and emitter 24', or may include a detent arrangement for securing light beam generator and emitter 24' at certain predetermined angles relative to spray pattern centerline $A_p$.

Figure 11:
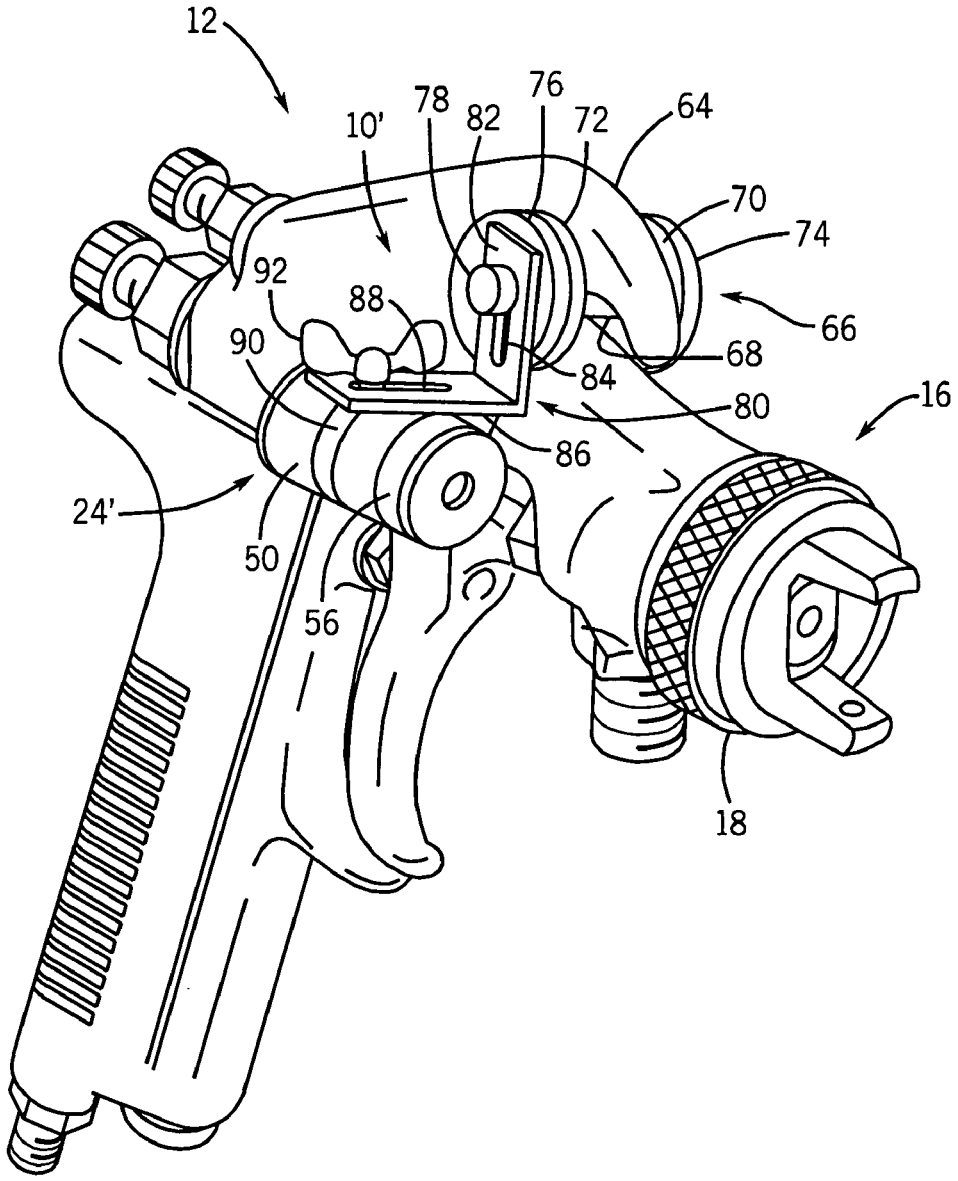
FIG. 11 is an isometric view of another embodiment of a targeting and positioning system for use in positioning a spray apparatus relative to a surface.

FIG. 11 illustrates an alternative mounting arrangement for securing light beam generator and emitter 24' to spray gun 12. This embodiment takes advantage of a conventional hook 64 which is typically included on the body of spray gun 12, in order to mount light beam generator and emitter 24'. This type of mounting arrangement provides a targeting and positioning system 10' which can be mounted to spray gun 12 independent of engagement with the spray head 16, since the diameter or configuration of the spray head ring or collar 18 can vary from gun to gun. This embodiment utilizes a spool assembly 66 engageable with hook 64 and the adjacent areas of the body of spray gun 12, in a manner as shown and described in pending patent application Ser. No. 09730241 filed Dec. 5, 2000 now U.S. Pat. No. 6,557,815, the disclosure of which is hereby incorporated by reference. The spool assembly 66 includes a center rod or shaft 68, two inner disks 70, 72, and two outer disks 74, 76 located outwardly of inner disks 70, 72, respectively. The inner disks 70, 72 are made of or coated with a non-slip material, such as rubber or soft plastic, to prevent rotation of the spool assembly 66 relative to hook 64. The outer disks 74, 76 can be constructed from metal, and may representatively be typical metal washers. The rod 68 is threaded and includes a head 78 on one end. At its opposite end, rod 68 is threadedly engaged with a nut or the like located outwardly of outer disk 74, or within a threaded opening formed in outer disk 74. In this manner, spool assembly 66 is releasably engaged with spray gun 12 utilizing the space between hook 64 and the spray gun body.

An L-shaped bracket 80 is employed to secure light beam generator and emitter 24' to spool assembly 66. Bracket 80 includes an upright leg 82 having a slot 84, and an outwardly extending leg 86 having a slot 88. Rod 68 extends through slot 84 in upright leg 82 and head 78 engages the areas of upright leg 82 adjacent slot 84, for securing bracket 80 to spool assembly 66 such that the position of bracket 80 can be adjusted along the longitudinal axis of slot 84.

A mounting ring 90 is secured about body 50 of light beam generator and emitter 24', and includes an upstanding threaded stud which extends through slot 88 in outwardly extending leg 86. A wing nut 92 engages the threaded stud and is engageable with the areas of outwardly extending leg 86 adjacent slot 88, for selectively fixing light beam generator and emitter 24' to outwardly extending leg 86 in a desired position.

With this arrangement, the user is able to adjust the vertical position of light beam generator and emitter 24' utilizing upright slot 84, as well as its orientation relative to a horizontal axis coincident with the longitudinal axis of rod 68. The user is also able to adjust the lateral position of light beam generator and emitter 24' using slot 88, and its angular position using wing nut 92. The user can thus set the position and angle of light beam generator and emitter 24' according to a desired convergence angle relative to the center of the spray pattern emitted by spray gun 12, to target and position spray gun 12 in the same manner as described previously.

Figure 12:
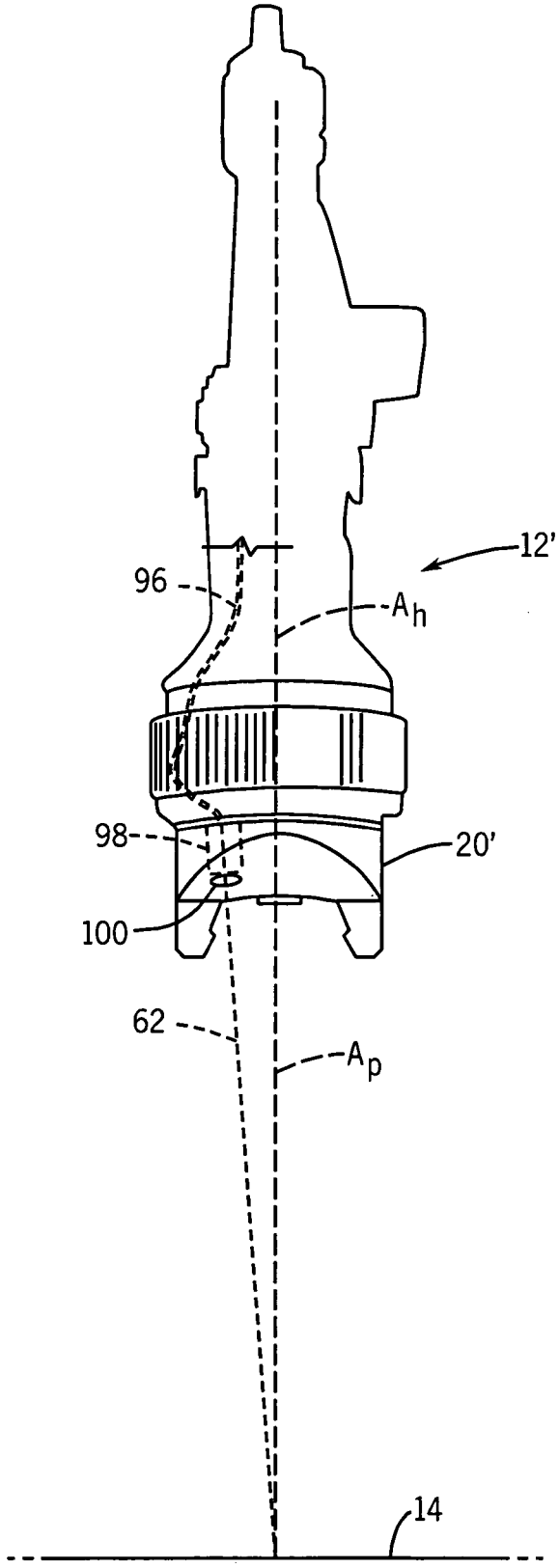
FIG. 12 is a top plan view showing another embodiment of a spray apparatus targeting and positioning system in accordance with the invention.
Figure 13:
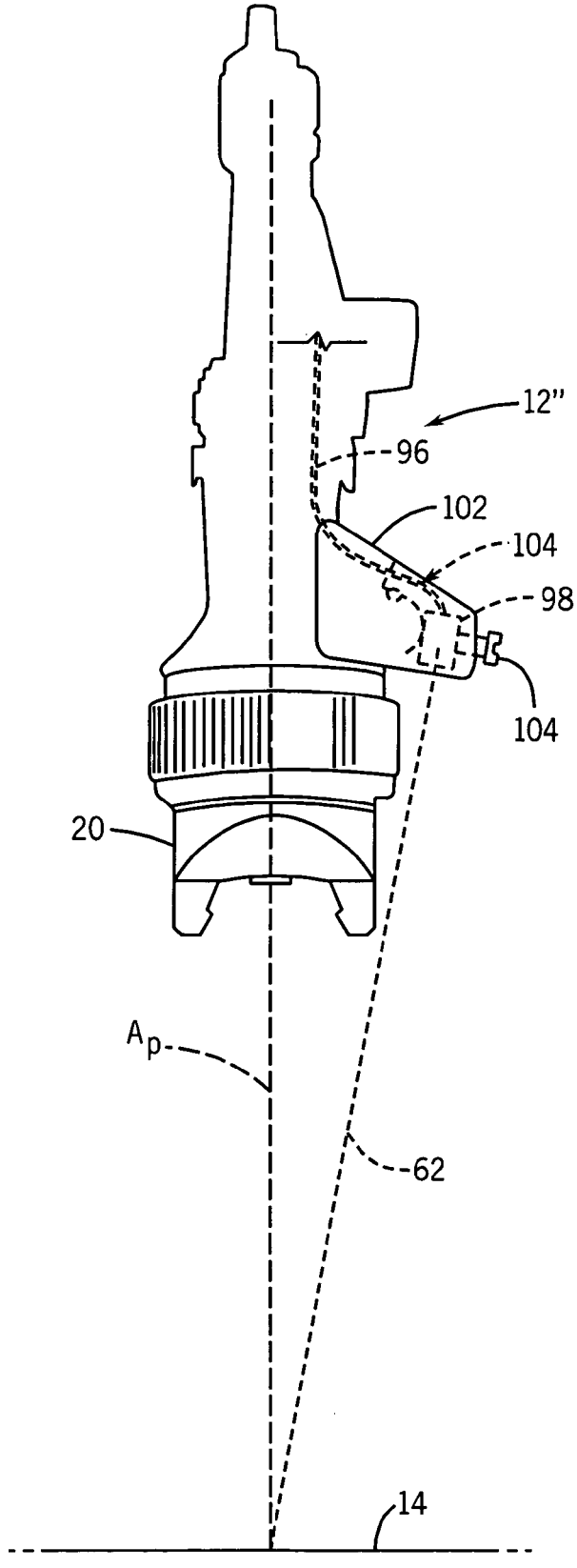
FIG. 13 is a top plan view showing yet another embodiment of a spray apparatus targeting and positioning system in accordance with the invention.

FIGS. 12 and 13 illustrate alternative embodiments of the present invention, in which the single light beam emitter is incorporated into the structure of the spray gun. As shown in FIG. 12, a spray gun 12' includes a light beam generator within its interior. A beam-transmitting cable 96 extends within the interior of the body of spray gun 12', and is connected to an emitter 98 mounted within the structure of spray nozzle 20'. Emitter 98 is oriented so as to emit light beam 62 at a predetermined angle relative to the spray head axis $A_h$ through an aperture 100 formed in the outer face of nozzle 20'. Light beam 62 thus converges in a direction toward surface 14 at a predetermined angle relative to the spray pattern axis $A_p$.

FIG. 13 illustrates a somewhat similar arrangement, in which emitter 98 is contained within a housing 102 extending outwardly from the side of the body of spray gun 12'. Emitter 98 is movable to varying angular positions via a pivotal mounting system 104 located in the interior of housing 102. An adjustment screw 104 is engaged with emitter 98, for enabling a user to adjust the angle of emitter 98 and thereby the angle of convergence of light beam 62 relative to the spray pattern centerline $A_p$.

While the invention has been shown and described with respect to certain embodiments of a light beam generator being mounted to a spray gun, it is to be understood that the invention contemplates any means of generating a single light beam for use in determining the position of the spray apparatus relative to the substrate or surface. For example, a light beam generator may be assembled into other portions of the housing, other components of spray gun, or other types of spray gun accessories or attachments. Further, in a removable mounting arrangement as shown, the light beam generator and emitter may be secured to spray gun 12 in any satisfactory location and position, so long as the position of light beam 62 relative to the emitter spray pattern can be ascertained. It is contemplated that certain mounting arrangements and styles may be provided for different spray gun configurations or other spray parameters, such that a spray gun owner can purchase a targeting and positioning system 10 designed specifically for the specific type of spray gun or spray coating. A manufacturer may also offer adjustable position versions as noted above, wherein the operator manipulates the angle of emitter head 56 to adjust the distance of convergence, or the manufacturer may offer fixed-position versions so as to reduce operator error in ensuring that the light beam is emitted at the proper angle to provide optimal positioning of the spray head. In addition, while the invention has been shown and described with respect to convergence of the single light beam with the spray pattern centerline to determine the position of the spray apparatus relative to the surface, it is contemplated that other arrangements may be employed. For example, the single light beam may be oriented to strike the surface at a position corresponding to a point or area of the spray pattern other than the centerline, e.g. an outer edge of the spray pattern. Further, while the invention has been shown and described with respect to a single light beam that provides a point of light which strikes the surface, it is also understood that other light patterns or configurations may be formed to impinge on the surface and provide a reference for directing the spray pattern onto the surface.

Various alternatives and embodiments are contemplated as being within the scope of the following claims particularly pointing out and distinctly claiming the subject matter regarded as the invention.

We claim:

1. A method of positioning a spray apparatus relative to a surface, wherein the spray apparatus emits a liquid spray in an axial direction which impinges upon the surface in a spray pattern, comprising the steps of:

directing a single light beam from the spray apparatus toward and onto the surface, wherein the light beam is oriented so as to be non-parallel to the axial direction of the liquid spray, and wherein the single light beam is further oriented so as to strike the surface in a predetermined position relative to and within the spray pattern when the spray apparatus is a predetermined distance from the surface as determined by the angle of the single light beam relative to the axial direction of the liquid spray;

positioning the spray apparatus while directing the single light beam toward and onto the surface;

operating the spray apparatus simultaneously while directing the single light beam toward and onto the surface, wherein the spray apparatus applies the liquid to the surface in the spray pattern and wherein the single light beam penetrates the spray pattern and strikes the surface within the spray pattern;

viewing the position of the light beam within the spray pattern on the surface so as to ascertain whether the light beam is in the predetermined position within the spray pattern and thereby whether the spray apparatus is at the predetermined distance from the surface; and adjusting the distance of the spray apparatus relative to the surface while simultaneously directing the single light beam toward and onto the surface and operating the spray apparatus to emit the liquid toward the surface so as to position the single light beam in the predetermined position relative to and within the spray pattern, and thereby to position the spray apparatus at the predetermined distance from the surface.

2. The method of claim 1, wherein the light beam is oriented relative to the axial direction of the liquid spray to strike the surface in the center of the spray pattern when the spray apparatus is the predetermined distance from the surface.

3. The method of claim 1, wherein the light beam is produced by a light beam emitter, and further comprising the step of releasably engaging the light beam emitter with the spray apparatus.

4. The method of claim 3, wherein the step of releasably engaging the light beam emitter with the spray apparatus is carried out by securing the light beam emitter to an emitter support arrangement, and releasably securing the emitter support arrangement to the spray apparatus.

5. The method of claim 4, wherein the emitter support arrangement includes a pair of clamping members movable toward and away from each other, and wherein the step of releasably securing the emitter support arrangement to the spray apparatus is carried out by engaging the pair of clamp members about a portion of the spray apparatus and securing the clamp members together.

6. The method of claim 4, wherein the step of engaging the light beam emitter with the spray apparatus is carried out by engaging the emitter support arrangement with a hook structure associated with the spray apparatus.

7. The method of claim 2, further comprising the step of varying the orientation of the light beam relative to the liquid spray so as to vary the predetermined distance of the spray apparatus at which the light beam strikes the surface in the center defined by the spray pattern.

8. The method of claim 7, wherein the light beam is produced by a light beam emitter interconnected with a releasable engagement arrangement, and wherein the step of varying the orientation of the light beam is carried out by varying the position of the light beam emitter relative to the releasable engagement arrangement.

9. The method of claim 7, wherein the light beam is produced by a light beam emitter having a first housing section secured to a releasable engagement arrangement for engaging the light beam emitter with the spray apparatus, and a second housing section from which the light beam is emitted, and wherein the step of varying the orientation of the light beam is carried out by varying the position of the second housing section relative to the first housing section.

10. The method of claim 1, wherein the step of directing a single light beam toward and onto the surface is carried out using a light beam emitter that is housed within the spray apparatus.

11. The method of claim 1, wherein the step of directing a single light beam toward and onto the surface is carried out using a light beam emitter that is mounted to a support arm extending laterally outwardly from the spray apparatus, wherein the light beam emitter is secured to an outer end defined by the support arm.

12. The method of claim 1, wherein the step of directing a single light beam toward and onto the surface is carried out using a light beam emitter that includes a spray device engagement portion oriented in a plane which is substantially perpendicular to a the axial direction of the liquid spray, and wherein the light beam emitter is constructed and arranged so as to emit the light beam at an angle relative to the plane of the engagement portion.

13. The method of claim 12, wherein the light beam emitter includes a first housing section interconnected with the spray device engagement portion and a second housing section from which the light beam is emitted, wherein the position of the second housing section relative to the first housing section is capable of variation so as to vary the angle of the light beam.

14. The method of claim 13, wherein the position of the second housing section relative to the first housing section is varied by positioning one of a plurality of differently configured spacer members between the first housing section and the second housing section.

* * * * *